United States Patent [19]

Fitzgerald-Smith et al.

[11] Patent Number: 4,520,523

[45] Date of Patent: Jun. 4, 1985

[54] BRIDGE MODULE FOR USE IN A CRANE ASSISTED METHOD OF BUILDING A TRANSPORTABLE GIRDER BRIDGE

[75] Inventors: James P. Fitzgerald-Smith, Ossemsley, Nr. New Milton; Bertram Bird, Bournemouth; Michael Willis, Ryde, all of England

[73] Assignee: The Secretary of State for Defence in Her Britannic Majesty's Government of the United Kingdom of Great Britain and Northern Ireland, Great Britain

[21] Appl. No.: 432,828

[22] Filed: Oct. 5, 1982

[30] Foreign Application Priority Data

Oct. 5, 1981 [GB] United Kingdom ..... 8130029

[51] Int. Cl.[3] ..... E01D 15/12; E01D 21/04

[52] U.S. Cl. ..... 14/2.4; 14/4; 14/14; 14/17

[58] Field of Search ..... 14/4, 17, 2.4, 2.6, 14/14, 13, 1; 52/108, 585, 726, 126.5; 29/155 R; 403/364, 409, 408, 3, 4

[56] References Cited

U.S. PATENT DOCUMENTS

| | | | |
|---|---|---|---|
| 2,647,270 | 8/1953 | Frost | 14/13 |
| 2,762,069 | 9/1956 | Laycock | 14/1 |
| 3,394,419 | 7/1968 | Sedlacek | 14/13 |
| 3,411,167 | 11/1968 | Sedlacek | 14/14 X |
| 3,438,076 | 4/1969 | Sedlacek | 14/14 |
| 3,504,389 | 4/1970 | Longbottom | 14/13 |
| 3,528,691 | 9/1970 | Matich, Jr. | 403/409 X |
| 3,750,987 | 7/1973 | Gobel | 52/126 X |
| 3,832,748 | 9/1974 | Ogletree | 14/1 |
| 4,007,507 | 2/1977 | Hansen | 14/17 |
| 4,073,025 | 2/1978 | Peckham | 14/2.4 |
| 4,288,881 | 9/1981 | Mahnckey | 14/2.4 |

FOREIGN PATENT DOCUMENTS

| | | | |
|---|---|---|---|
| 2052107 | 10/1978 | Fed. Rep. of Germany | 14/17 |
| 473948 | 6/1969 | Switzerland . | |
| 548439 | 10/1942 | United Kingdom . | |
| 1089806 | 11/1967 | United Kingdom . | |
| 1209747 | 10/1970 | United Kingdom . | |
| 1594610 | 8/1981 | United Kingdom . | |

*Primary Examiner*—Stephen J. Novosad
*Assistant Examiner*—Beverly E. Hjorth
*Attorney, Agent, or Firm*—Cushman, Darby & Cushman

[57] ABSTRACT

A bridge module is preassembled from girder sections the type disclosed in Pat. No. GB 1209747, and integrated by stabilizing means so as to provide a crane-assisted building method which is less labor intensive and less time consuming than known manual methods.

4 Claims, 10 Drawing Figures

Figure 1:
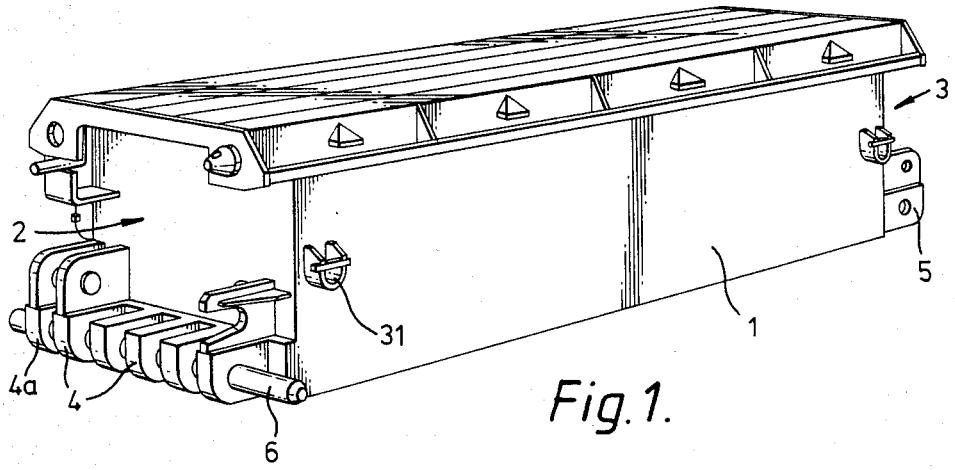

Fig. 5.
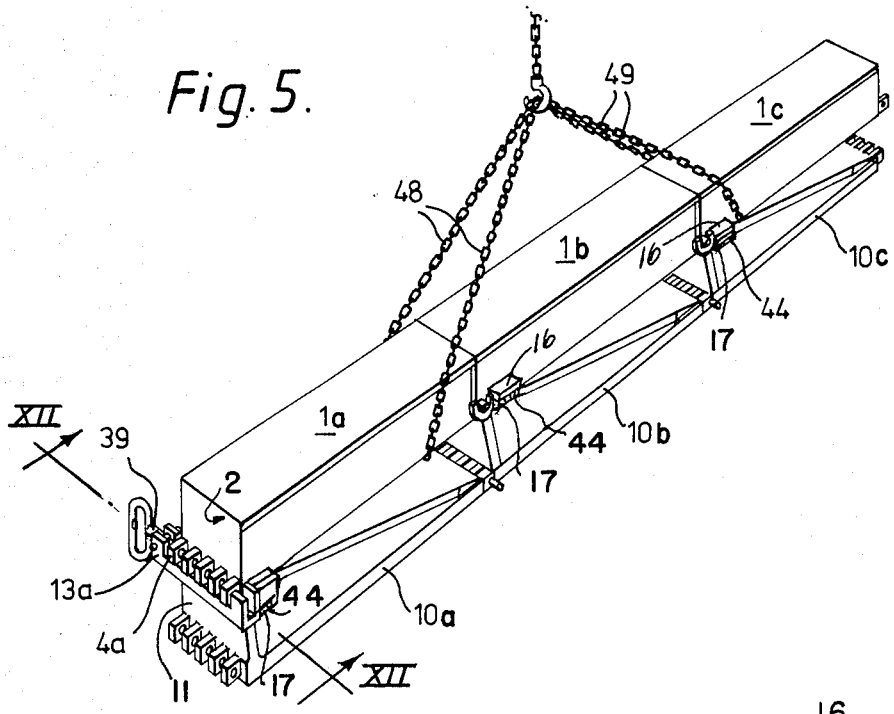
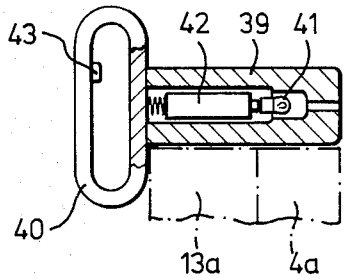
Fig. 6.
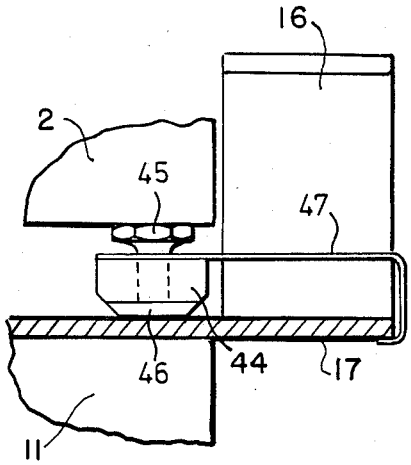
Fig. 7.

BRIDGE MODULE FOR USE IN A CRANE ASSISTED METHOD OF BUILDING A TRANSPORTABLE GIRDER BRIDGE

This invention relates to a bridge module which provides a crane assisted method of building a transportable girder bridge from double storey girder sections of the type described in UK Pat. No. 1209747.

Building bridges of the above-mentioned type can be labour intensive and time consuming, all the girder sections normally being lifted and assembled manually. Obviously the effort required at the building site could be reduced by transporting to the site groups of girder sections which have been preassembled into modules that can be lifted and positioned by crane. However, double storey modules preassembled from the upper and lower girder sections of the prior art would not be independently stable, because of their interdependent system of connection. Each upper girder section has been designed to be secured to the next upper girder section by means of a pin passed transversely through an interdigitated array of perforated tongues, the lower girder sections being provided with U-shaped sockets which can be held captive around the pins interconnecting the upper girders by means of shoot bolts through holes provided in the sockets. Consequently the lower sections cannot be secured to the upper sections until the upper section has been pinned to the next adjoining upper section.

It is an object of the present invention to provide a double storey bridge module that can be integrally preassembled from the prior art girder sections, so as to provide a crane assisted method of building.

In accordance with the present invention a bridge module assembled from at least one pair of interconnectable upper and lower girder sections of the type hereinbefore defined further includes a stabilising means attached between the upper and lower girder sections adjacent at least one end of the module.

The stabilising means may conveniently comprise a rigid connector post having the form of a double height girder having connecting means which are engagable with those of the upper and lower girder sections conjointly. Alternatively, the stabilising means may comprise an adjustable link which can be fitted between an existing carrying handle socket of the upper girder section and the shoot bolt holes of the lower girder section. Neither of these stabilising means interfere with normal interconnection procedures between adjoining modules and both remain attached to the modules in subsequent use.

A less expensive, alternative stabilising means comprises a stub pin engagable between one of the U-shaped sockets of the lower girder section and an end one of the perforated tongues of the upper girder section. This pin is used in conjunction with an associated packing piece and has to be removed during interconnection of adjoining modules, a rigorous construction drill being employed for the purpose.

Use of any of these stabilising means to integrate the preassembled girder sections makes crane assisted building of the prior art bridge possible. A method for such building of a dry support bridge comprises the steps of;

a. positioning launch rollers and assembling a launching nose from a plurality of nose girders with a first vehicle mounted crane, b. positioning a building frame and assembling thereon two pluralities of the integrated modules to form two parallel trackways, with the use of a second and a third vehicle mounted crane, c. positioning the assembled launching nose between the parallel trackways with the first vehicle mounted crane, and d. positioning decking stacks at predetermined intervals along the trackways with a fourth vehicle mounted crane.

A major time consuming factor in the manual assembly of the prior art bridge, is that the launching nose has to be asembled amd cantilevered out across the gap from the launch rollers before assembly of the bridge girders can be commenced. The present crane assisted method is particularly advantageous in this respect as the launching nose can be built concurrently with the trackways, thus substantially reducing the overall time needed for completion.

The decking stacks used in step d. may conveniently comprise decking units piled upon a decking pallet which itself comprises a number of the decking units interconnected to form a pallet which may be fitted directly to the trackways as described in co-pending patent application No. GB 8130027.

Double storey end-of-bridge modules may also be fitted to the trackways, in appropriate sequence, in step b.

The integrated modules may of course also be employed for building other known bridge configurations, eg a floating bridge, the steps a. and c. of the dry support bridge building method, ie those involving assembly and deployment of a launching nose, being replaced by conventional pontoon deployment procedure.

Figure 2:
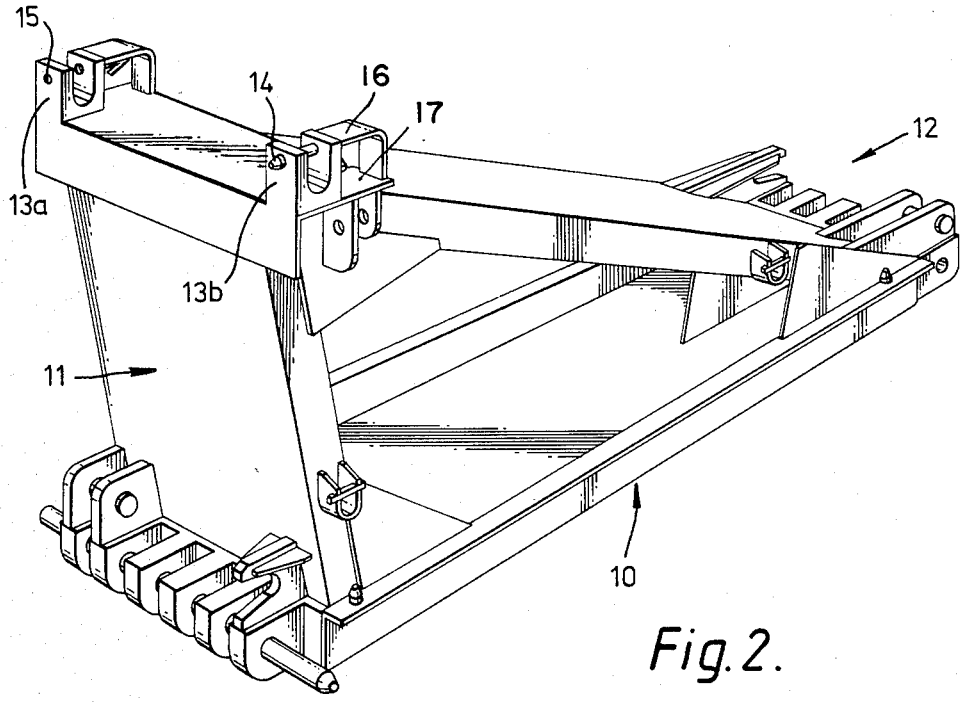
Figure 3:
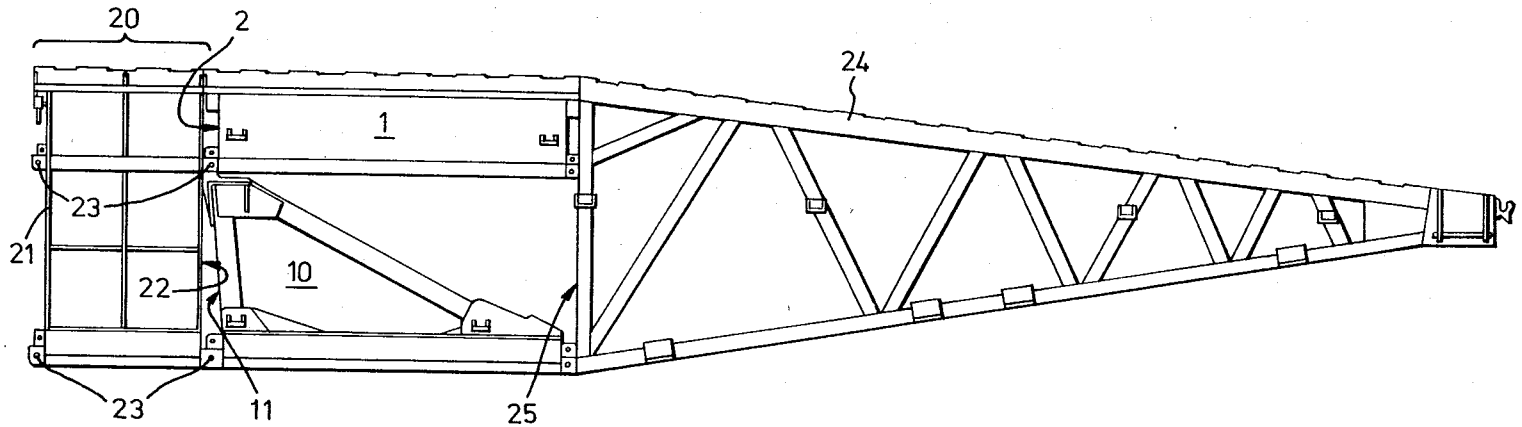
Figure 4:
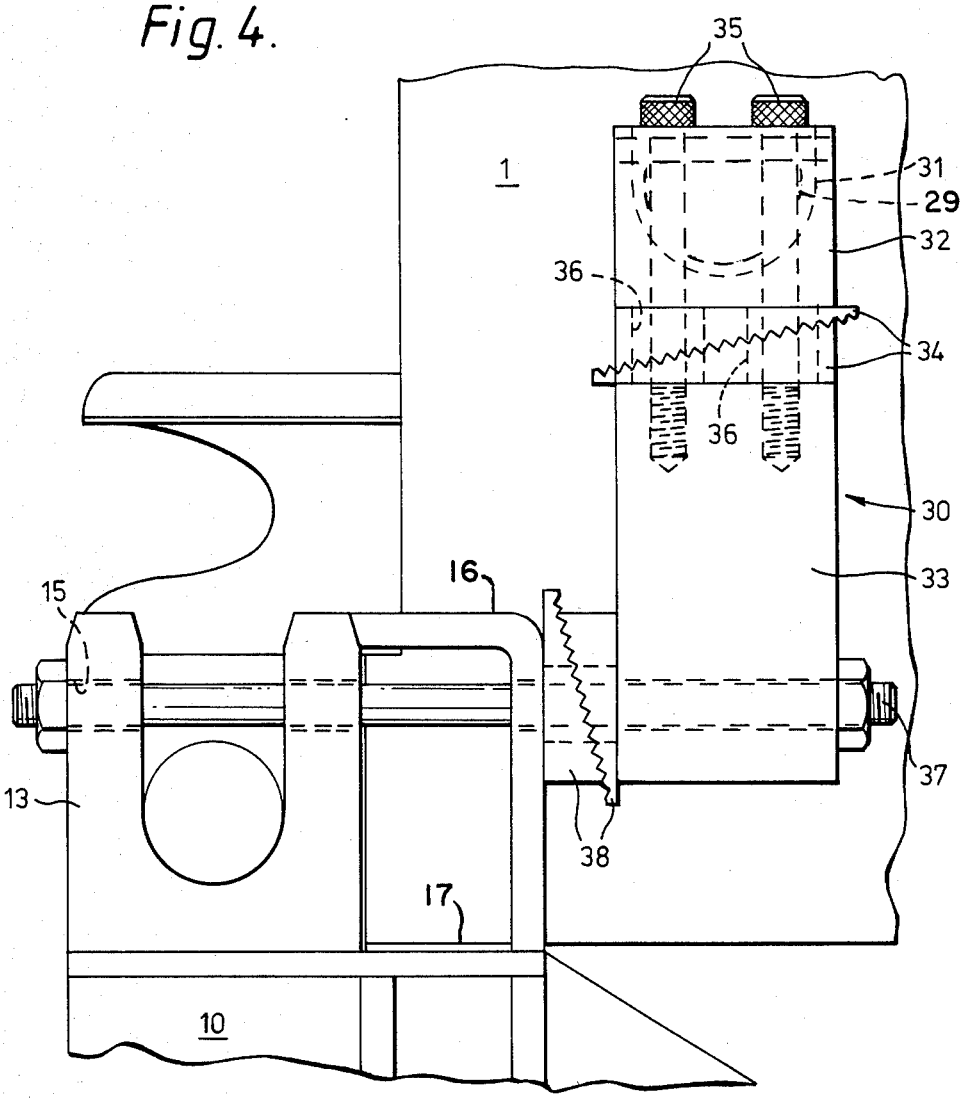

Embodiments of the invention will now be described by way of example only with reference to the following drawings of which:

FIGS. 1 and 2 are perspective views of the upper and lower girder sections respectively of the prior art, FIG. 3 is a side elevation of an end-of bridge module, showing the girder sections of FIGS. 1 and 2 conjointly attached at one end to a connector post stabilising means and at the other to an end-of-bridge girder, FIG. 4 is a side elevation of an adjustable tie-bar stabilising means which may be used as an alternative to the connector post of FIG. 3.

Figure 8:
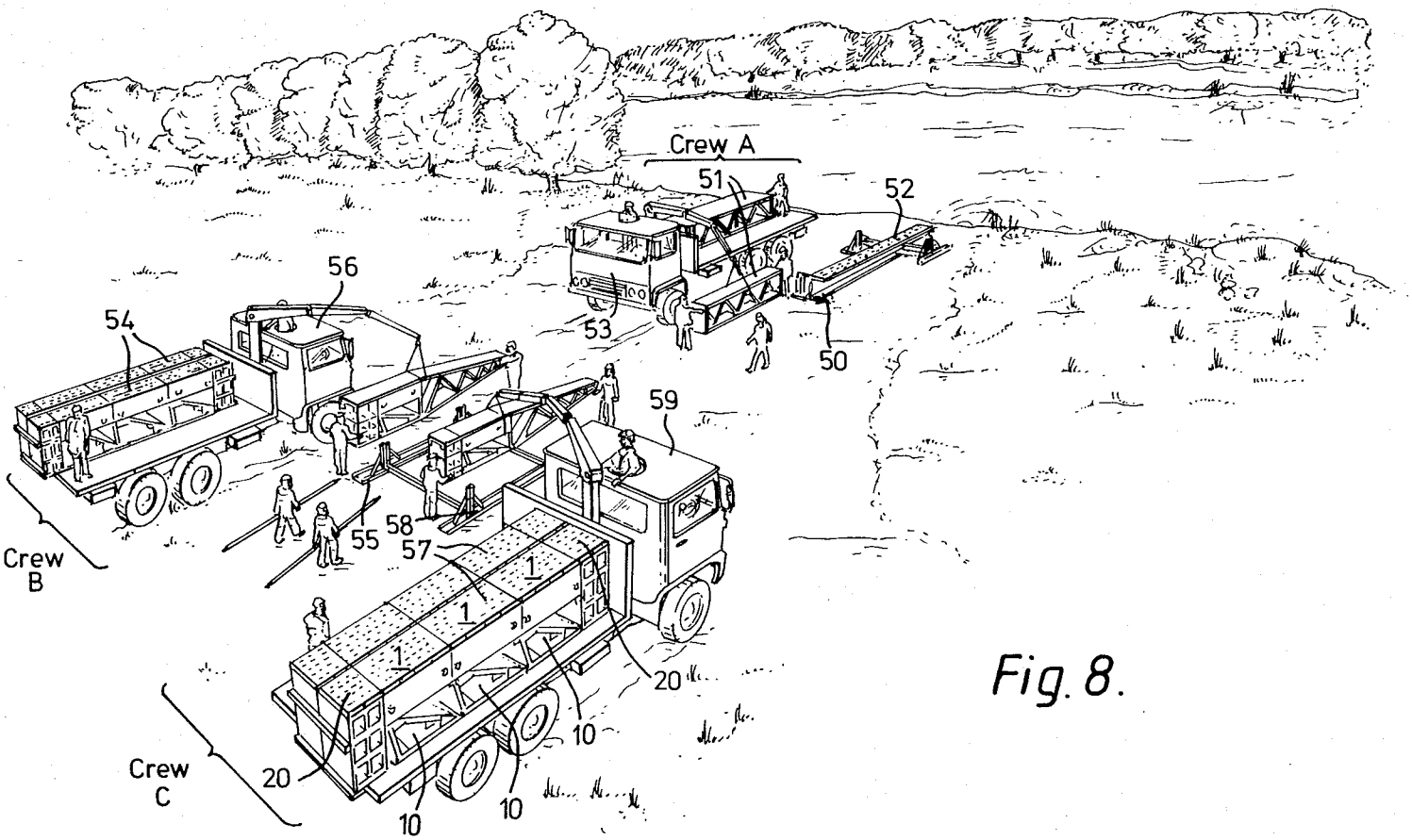
Figure 9:
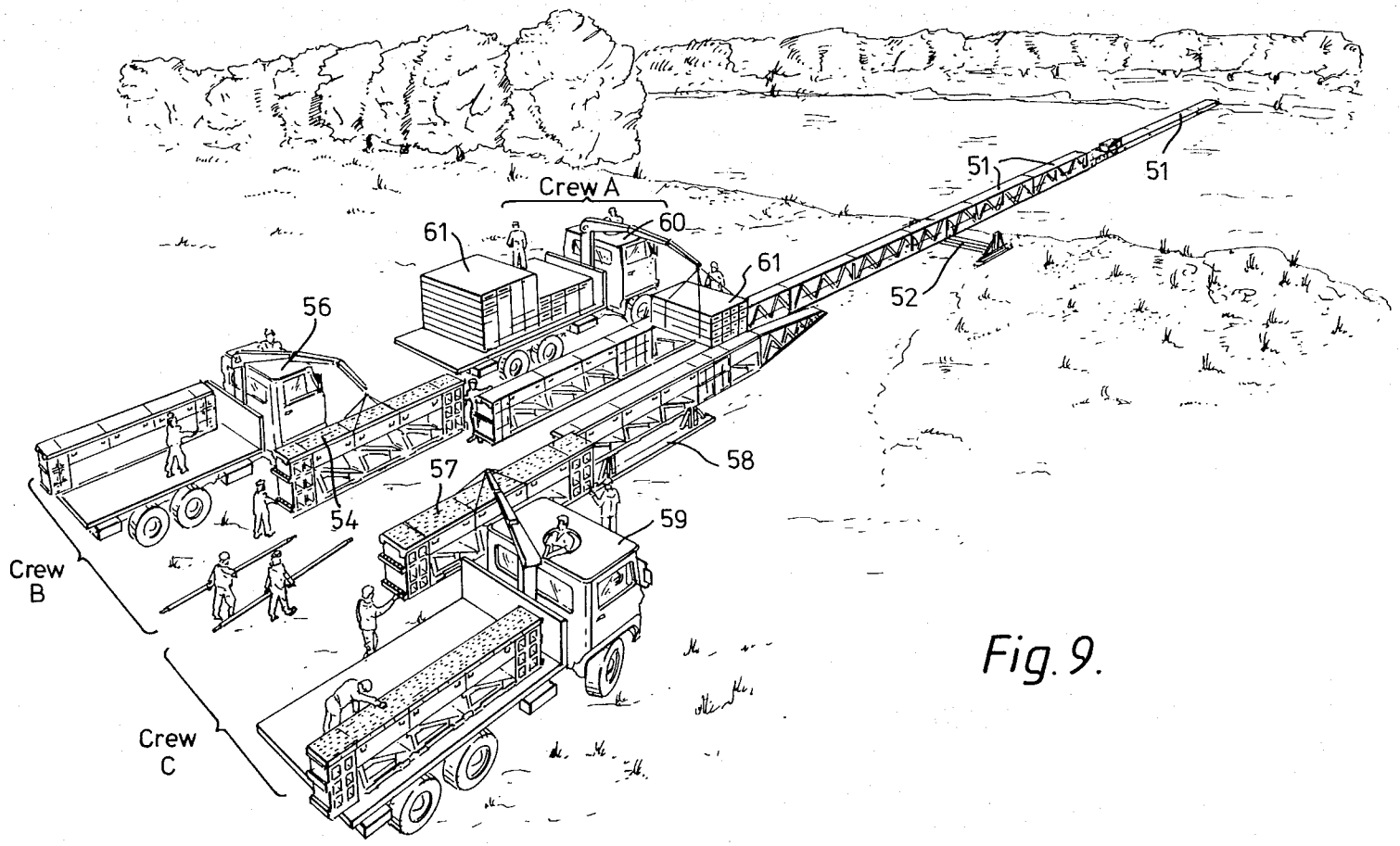
Figure 10:
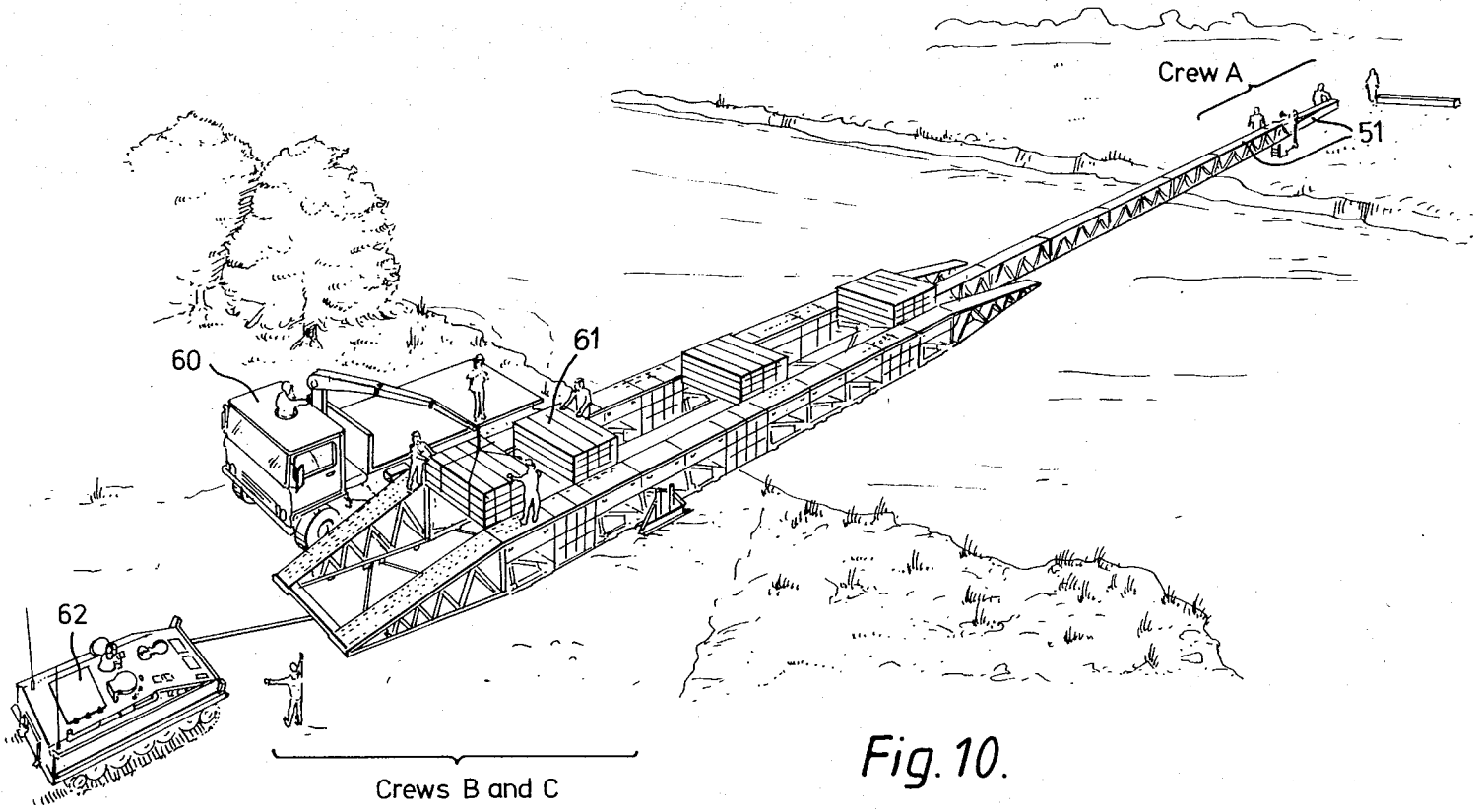

FIG. 5 is a perspective view of an integrated triple-girder module having a stub pin stabilising means and associated packing pieces, FIG. 6 is an axial section through the stub pin illustrated in FIG. 5, FIG. 7 is a side elevation of the packing piece illustrated in FIG. 5 as seen from line VII—VII, and FIGS. 8, 9 and 10 illustrate in sequence a crane assisted assembly and launch procedure for a 30 m double storey bridge.

An upper girder section 1 illustrated in FIG. 1 has end faces 2 and 3 respectively provided with an array of perforated tongues 4 and 5 which can be interdigitated with those of an adjoining similar girder. The tongues 4 and 5 are held together by a pin 6 which is inserted through the aligned perforations.

A triangular, lower girder section 10 illustrated in FIG. 2 has an identical interdigitating tongue arrangement at the lower edges of it two end faces 11 and 12 and is provided at the upper edge of the end face 11 with two U-shaped sockets 13 which, when the girders 1 and 10 are to be interconnected, are positioned about the two ends of the pin 6 and secured by means of shoot bolts 14 in holes 15. The shoot bolts 14 are retractable into shoot bolt housings 16 adjacent the sockets 13 when not engaged in the holes 15, the housing 16 and the sockets 13 all being conjointly mounted on a platform 17.

Obviously the pin 6 cannot be inserted through the perforated tongues 4 of the upper girder section 1 to support the lower girder section 10 until the tongues have been interdigitated with the tongues 5 of an adjoining girder section, thus making it impossible to preassemble a plurality of upper and lower girders into a double storey module which is sufficiently stable at the end faces 2 and 11 for lifting into position by crane for interconnection with another similar module.

A first embodiment of the stabilising means for integrating the two free end faces 2 and 11 of a module is illustrated in FIG. 3. This embodiment comprises a connector post 20 having two identical end faces 21 and 22, each provided with an upper and lower set of perforated tongues 23 which will mate with the tongues at either end of the upper and lower girders 1 and 10 conjointly. The post 20 is conveniently designed to be half the length of the girders 1 and 10 so that one attached at each end of a module will make the total length of the module a whole number of girder sections. Each post 20 must of course also be of strength commensurate with the rest of the girder sections, as it forms an integral part of the bridge.

As illustrated in FIG. 3 however, the girder sections 1 and 10 are conjointly attached at their second end to an end-of-bridge girder 24 provided with an end face 25 which has identical interlock arrangements to that of the end face 21 of the post 20.

A second embodiment of the stabilising means which does not have to carry the loading of the assembled bridge is illustrated in FIG. 4. This embodiment adds no additional length to the modules and is less expensive to manufacture than the connector post. The embodiment comprises at tie bar 30 having a downwardly hooked tongue 29 which is engageable with an existing carrying handle socket 31 (see also FIG. 1) of the upper girder section 1. Because the socket 31 is not precisely located on the girder, the tie bar 30 is of adjustable proportions and comprises two portions 32 and 33 which are spaced apart by a pair of serrated wedges 34. The lateral displacement of the wedges can be relatively adjusted to increase or diminish the spacing between the two portions 32 and 33, which portions are held together by screws 35 which extend through clearance slots 36 in the wedges 34.

The portion 33 supports a shoot bolt 37 which engages via the shoot bolt housing 16 with the holes 15 in the socket 13 of the lower girder section 10, separation of the tie bar 30 from the housing 16 and hence alignment of the shoot bolt 37, being determined by a second pair of adjustable serrated wedges 38.

This embodiment of the stabilising means remains in position when adjoining modules are interconnected and hence causes a slight restriction in the flexibility of the interconnecting pin joint. This effect can be reduced by the addition of resilient backing pieces (not shown) to each pair of wedges 34.

One mirror-imaged pair of the tie bars 30 fitted at either side of the exposed end faces 2 and 11 of the end pair of girders in a preassembled module is sufficient to ensure integrity of the module, the relative location of the girder section end faces 3 and 12 at the other end of the module being maintained by cantilever action against the adjoining sections.

A third embodiment of the stabilising means is illustrated in FIGS. 5, 6 and 7, in use with a module comprising three upper girder sections 1*a*, 1*b*, and 1*c* and three lower sections 10*a*, 10*b* and 10*c*. This stabilising means comprises a stub pin 39 of just sufficient length to engage the socket 13*a* of the lower girder section 10*a* with the end tongue 4*a* of the upper girder section 1*a*. The pin 39 has a handle 40 (see FIG. 6) and may optionally be hollowed to contain a light bulb 41 and a battery 42 which can be interconnected by a switch 43 located in the handle 40, so as to permit covert illumination of the pin hole when used in darkness.

The upper and lower girder sections 1*c* and 10*c* remote from the stub pin 39 are maintained parallel with one another by a pair of packing pieces 44 (see FIG. 7) inserted between the two sections 1*c* and 10*c* adjacent the socket 13, prior to insertion of the associated assembly pin 6. The packing pieces 44 each carry a jacking screw 45 and a resilient pad 46 and are located with respect to the lower girder section by a hooked stop plate 47 which engages with the platform 17 of the shoot bolt housing 16.

In order to ease insertion of the stub pin 39 into the tongue 4*a* and the socket 13*a*, any misalignment caused by the cantilever effect of the assembled girder sections must be relieved by supporting their weight at the far end of the upper girder. Once the pin has been inserted and the relief removed, the pin remains locked in position by this contilever effect.

A construction procedure for interconnecting modules thus integrated is as follows:

a. The module is hoisted in a substantially horizontal attitude by means of two pairs of slinging chains 48 and 49 symmetrically attached to the upper girder sections, the module being positioned so as to interdigitate the upper and lower sets of the tongues 4 with the upper and lower sets of the tongues 5 of an adjoining module.

b. The lower set of interdigitated tongues 4 and 5 are pinned through with a normal assembly pin 6.

c. The slinging chains 48 are disconnected and the cantilever effect at the stub pin relieved by upwardly rotating the module about the pin 6 at the stub pin end by means of the slinging chains 49 until the stub pin can be withdrawn.

d. This module position is then maintained with the chains 49 until the stub pin 39 has been replaced by a normal assembly pin 6.

Interconnection is then complete.

A crane assisted method of constructing a 30 m double storey bridge from existing bridge building and launching apparatus, using modules that have been preassembled from three pairs of upper and lower girders 1 and 10 and integrated at each end with the first embodiment of the stabilising means, ie the connector post 20, is illustrated in FIGS. 8, 9 and 10. This method, which requires four vehicle mounted cranes and three four-man crews A, B and C, is capable of achieving a fully launched bridge within 30 minutes and is equally applicable to modules integrated with any of the aforesaid stabilising means. The construction stages are set out in the following Table I.

TABLE I

| Stage | FIG. | Procedure |
|---|---|---|
| 1 | 8 | Crew A transports a launching nose roller beam 50, launching nose girders 51 and a bridge roller beam 52 to a chosen launch site using a crane/vehicle 53.<br>Crew B transports left bridge modules 54 and a left building frame 55 to a position rearward and left of the launch site using a crane/vehicle 56.<br>Crew C transports right bridge modules 57 and a right building frame 58 to a position rearward and right of the launch site using crane/vehicle 59. |
| 2 | 8 | Crew A places the bridge and nose roller beams 52 and 50 in position for launch.<br>Crews B and C assemble the building frame 55/58 interjacent the crane/vehicles 56 and 58. |
| 3 | 8 | Crew A assembles the nose girders 51 to form a launching nose adjacent the nose roller beam 50.<br>Crews B and C assemble the bridge modules 54/57 on the building frame 55/58 into two parallel trackways which are boomed forward over the roller beam 52 as assembly proceeds. |
| 4 | 9 | Crew A lifts the assembled launching nose into position between the bridge modules 54 and 55 and on the roller beams 50 and 52, and interconnects the nose with the leading end of the trackways.<br>Crew B and C continue their stage 3 procedure. |
| 5 | 9 | Crew A replaces the crane/vehicle 53 with a crane/vehicle 60 carrying palleted decking units 61 and commences to transfer the palleted units to the trackways.<br>Crews B and C continue their stage 3 procedure. |
| 6 | 10 | The fully assembled bridge is now launched by conventional procedure using a separate pushing vehicle 62 whilst:—<br>Crew A crosses to the far bank on the launching nose and disconnects the nose girders 51 as each arrives.<br>Crews B and C complete the transfer of the palleted decking units 61 to the trackways and then distribute the individual decking units along the trackways. |

We claim:

1. A crane-assisted method for interconnecting a second bridge module to an identical first bridge module, said first and second modules each including upper and lower girder sections, said method including the steps of:

a. supporting the second module in a substantially horizontal attitude by means of two pairs of slinging chains symmetrically attached to the upper girder section, the second module being positioned so as to interdigitate tongues of exposed upper and lower first end faces respectively provided on the upper and lower girder sections of the second module with corresponding tongues of exposed second end faces respectively provided on the upper and lower girder sections of the first adjoining module, b. pinning the lower interdigitated tongues of the lower girder section with a first assembly pin;

c. disconnecting one pair of the slinging chains nearest to a stub pin and relieving the cantilever effect of the second module at the stub pin by upwardly rotating the second module about the first assembly pin by means of the other pair of slinging chains until the stub pin can be freely withdrawn and replaced by a second assembly pin; and d. disconnecting the other pair of slinging chains.

2. A bridge module comprising at least one pair of upper and lower girder sections, the upper girder section having a first and a second end face and two side faces, each side face being provided with a carrying handle socket adjacent each end face and each end face being provided with a plurality of tongues, those of the first end face being disposed to interdigitate with those of a confronted second end face of an adjoining identical upper girder section, each tongue being provided with a hole disposed to permit insertion of an assembly pin extending throughout the interdigitated tongues and providing a protrusive end portion at each of said side faces, and said lower girder section having a first and a second end face each provided with a plurality of tongues arranged to interdigitate and to be secured in similar manner to those of the upper girder sections, said first end face also being provided with a pair of upwardly directed U-shaped sockets respectively disposed to engage with the protrusive end portion of the assembly pin at each side face adjacent the first end face of the superjacent upper girder section, each U-shaped socket being further provided with a pair of shoot bolt holes disposed in alignment so as to permit insertion of a shoot bolt for holding the assembly pin captive within the socket; wherein the two girder sections are maintained, prior to insertion of the assembly pin at the first end faces, in correct paired position for interconnection with an adjoining girder section pair by a tie bar located adjacent each side face and having a lower end provided with a shoot bolt engaged with the shoot bolt holes of the U-shaped socket, and an upper end provided with a downwardly hooked tongue engaged with the carrying handle socket adjacent the first end face of the upper girder section.

3. A bridge module comprising at least one pair of upper and lower girder sections, the upper girder section having a first and a second end face and two side faces, each end face being provided with a plurality of tongues, those of the first end face being disposed to interdigitate with those of a confronted second end face of an adjoining identical upper girder section, each tongue being provided with a hole disposed to permit insertion of an assembly pin extending throughout the interdigitated tongues and providing a protrusive end portion at each of said two side faces, and said lower girder section having a first and a second end face, each provided with a plurality of tongues arranged to interdigitate and to be secured in similar manner to those of the upper girder sections, said first end face also being provided with a pair of shoot bolt housings and a pair of upwardly directed U-shaped sockets respectively disposed adjacent said shoot bolt housings to engage with the protrusive end portion of the assembly pin at each side face adjacent the first end face of the superjacent upper girder section, each U-shaped socket being further provided with a pair of shoot bolt holes disposed in alignment so as to permit insertion of a shoot bolt for holding the assembly pin captive within the socket, the shoot bolt being retractable into a shoot bolt housing adjoining the socket; wherein the two girder sections are maintained, prior to insertion of the assembly pin at the first end faces, in correct paired disposition for interconnection with an adjoining girder section pair by a stub pin secured in engagement with each U-shaped socket by the respective shoot bolt and protrusive into the adjacent first tongue only of the first end face of the upper girder section, a packing piece being provided interjacent the upper and lower girder sections and adjacent the stub pin, the packing piece including adjustment means to adjust the thickness of said packing piece for varying the angle between the upper and lower girder sections thereby to permit adjustment of the vertical separation of the unsupported second end face of the upper girder section from the second end face of the lower girder section.

4. A bridge module as claimed in claim 3 wherein the stub pin includes an axially recessed insertion end containing a light source and an electrical power supply, and a handle end containing an on/off switch arranged in circuit with the light source and the power supply.

* * * * *